United States Patent [19]

Simon et al.

[11] Patent Number: 4,980,662

[45] Date of Patent: Dec. 25, 1990

[54] MULTIPLEXED MICROWAVE FILTER, AND METHOD OF ADJUSTING SUCH A FILTER

[75] Inventors: Catherine Simon, Cergy Saint Christophe; Robert Le Roux, Asnieres; Marc Sauvage, Nanterre, all of France

[73] Assignee: Alcatel N.V., Amsterdam, Netherlands

[21] Appl. No.: 358,440

[22] Filed: May 26, 1989

[30] Foreign Application Priority Data

May 27, 1988 [FR] France ..... 88 07108

[51] Int. Cl.[5] ..... H01P 5/12; H01P 1/20

[52] U.S. Cl. ..... 333/134; 333/202; 333/230; 333/231

[58] Field of Search ..... 333/202, 210, 209, 211, 333/208, 230, 231, 134, 132, 129, 126

[56] References Cited

U.S. PATENT DOCUMENTS

| | | | |
|---|---|---|---|
| 2,910,659 | 10/1959 | Caroselli et al. | 333/98 |
| 3,105,207 | 9/1963 | Capewell et al. | 333/10 |
| 4,166,256 | 8/1979 | Shishido | 333/209 X |
| 4,249,147 | 2/1981 | Kaegebein | 333/230 X |
| 4,746,883 | 5/1988 | Sauvage et al. | 333/202 |

FOREIGN PATENT DOCUMENTS

| | | |
|---|---|---|
| 0205151 | 12/1986 | European Pat. Off. . |
| 3028925 | 2/1982 | Fed. Rep. of Germany . |

OTHER PUBLICATIONS

Mok, "Design of Evanescent-Mode Waveguide Diplexers", IEEE Trans. on MTT, vol. MTT-21, No. 1, Jan., 1973, pp. 43-48.

Patent abstracts of Japan, vol. 8, No. 229 (E-273) (1966), Oct. 20, 1984; and JP-A-59 110 202 (Nihon Dengiyou Kousaku K.K.) 06-26-1984.

*Primary Examiner*—Eugene R. LaRoche
*Assistant Examiner*—Seung Ham
*Attorney, Agent, or Firm*—Christie, Parker & Hale

[57] ABSTRACT

A multiplexed microwave filter comprising at least two elementary filters (10, 11) provided with respective coupling antennas of crankshaft or any other shape, and including a common access (14), which access is provided with a crankshaft-shaped coupling antenna which is rotatable about its axis in order to adjust coupling between the antenna and the corresponding elementary filter, in which the common access is situated astride the various elementary filters and includes as many crankshaft-shaped antennas (22, 23) as there are elementary filters (10, 11).

3 Claims, 3 Drawing Sheets

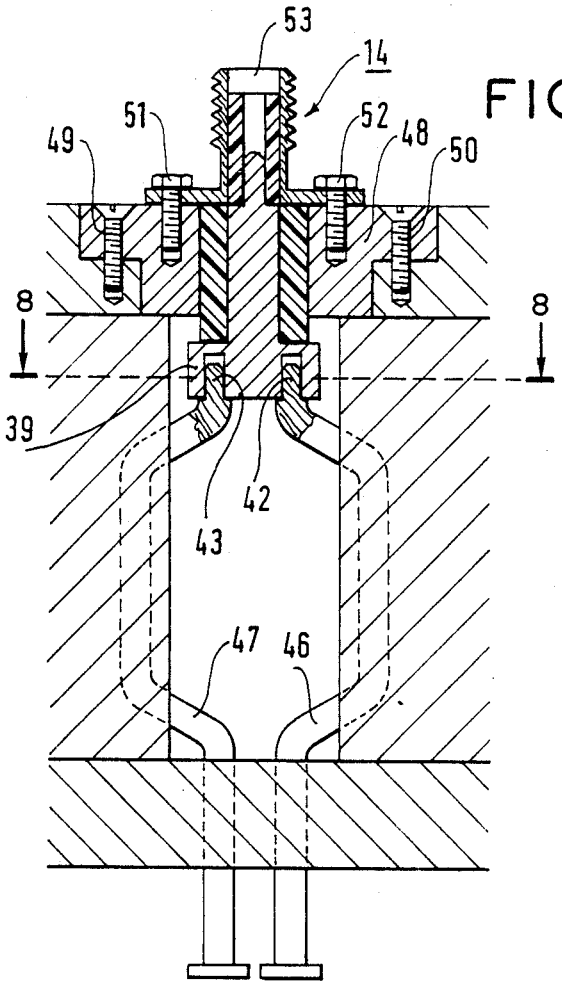
FIG. 7
FIG. 8
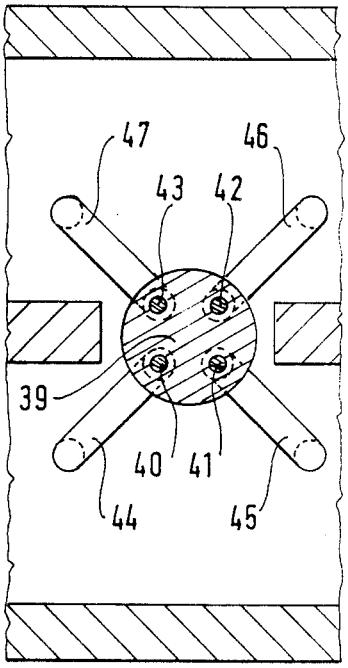

MULTIPLEXED MICROWAVE FILTER, AND METHOD OF ADJUSTING SUCH A FILTER

The invention relates to multiplexed microwave filters and to a method of adjusting them.

The invention relates to diplexed evanescent mode or comb line microwave bandpass branching filters. Such filters are tunable over a certain frequency band and have at least one common coaxial access. These filters are side-by-side or in line, one operating in one frequency band and the other in a different frequency band.

BACKGROUND OF THE INVENTION

A prior art filter is described in an article published in IEEE MTT Vol. 21 No. 1, January 1973, entitled "Design of evanescent mode waveguide diplexers". This article describes a new procedure for designing filters made up from waveguides below the cut-off. This design enables an entire diplexer to be constructed (with the entire device being constructed as a single waveguide, thereby making it possible to omit a T-junction and connection flanges), providing a coaxial link is used at the common junction. The design described uses bandpass filters which are suitable for bandwidths of a few percent.

With this type of diplexer, the tuning of the two filters is not independent and each filter interacts on the other. The tuning bands of the filters must necessarily be very close to each other since the two filters share a common resonator. In addition, the bandwidth cannot exceed a few percent. Further, this diplexer is necessarily constituted by two in-line filters.

The object of the invention is to make the filters independent from each other, i.e. such that there is no interaction between the filters when one of them is adjusted, thereby simplifying adjustment.

SUMMARY OF THE INVENTION

To this end, the present invention provides a multiplexed microwave filter comprising at least two elementary filters provided with respective coupling antennas of crankshaft or any other shape, and including a common access, said access being provided with a crankshaft-shaped coupling antenna which is rotatable about its axis in order to adjust coupling between the antenna and the corresponding elementary filter, wherein the common access is situated astride the various elementary filters and includes as many crankshaft-shaped antennas as there are elementary filters.

Advantageously, there is no limit on the spacing between the tuning frequencies of the two elementary filters, and these filters may be wideband or narrow band filters.

In one embodiment, the common access comprises:

a coaxial base;

a first "plug" part for closing the waveguide after the two crankshaft-shaped antennas have been put into place, said part being inserted in a hollow in the wall common to the two filters in such a manner as to be held in place by the coaxial base;

a common part for the purpose of electrically connecting the coaxial base to the antennas, the common part has a small-diameter end for being received at a close fit in the coaxial base;

the common access includes an insulating tube through which the common part is passed in order to avoid any short circuit between the common part and the "plug" part;

two crankshaft-shaped coupling antennas whose small-diameter ends are inserted as close fits in the holes in the common part so as to enable said antennas to rotate, with the other ends thereof projecting outside the filter via respective holes situated on the same axes as the small-diameter ends; and a screw for preventing each antenna from rotating, said screw passing through the body of the filter and bearing against the corresponding antenna.

Such an embodiment of a filter of the invention is simple and provides higher performance than provided by prior art devices.

The elementary filters may be provided in-line or side-by-side. In particular, the invention may be applied to two filters in-line, to two side-by-side filters, to three filters constituting a "triplexer", or to four filters constituting a "quadriplexer".

Advantageously, in the method of adjusting such filters:

the antenna of each of the filters but one is locked in position, thereby enabling the said one filter whose antenna is not locked to be adjusted;

once said adjustment has been performed, the antenna of said filter is locked in position;

thereafter the antenna of another filter is unlocked and said other filter is adjusted, after which its antenna is locked in position; and all of the elementary filters are adjusted in succession in this manner.

BRIEF DESCRIPTION OF THE DRAWINGS

Embodiments of the invention are described by way of example with reference to the accompanying drawings, in which:

FIG. 7 is a fragmentary cross-section view through a filter of the invention; and FIG. 8 is a fragmentary longitudinal section on a plane VIII—VIII of the filter shown in FIG. 7.

DETAILED DESCRIPTION

Figure 1:
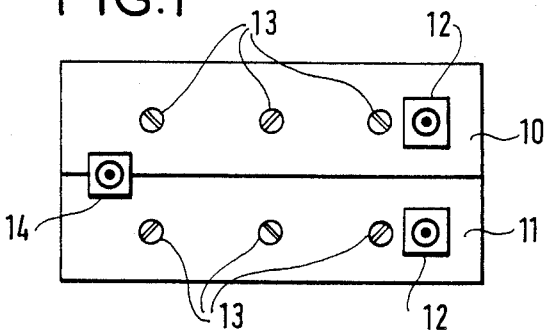
FIGS. 1 to 4 are diagrams of different types of filters of the invention.

The filter of the invention shown in FIG. 1 comprises:

two side-by-side elementary filters 10 and 11 made using comb line technology or evanescent technology and having an unlimited number of poles (in the example shown, there are two filters each having three poles);

two independent accesses 12 each fitted with a crankshaft-shaped coupling antenna rotatable about its axis in order to adjust the coupling between the antenna and the filter, (such an antenna is described in U.S. Pat. No. 4 746 883);

a common access 14 which uses an antenna of the same type but in a different manner; and adjustment screws 13 for tuning the filters.

Figure 2:
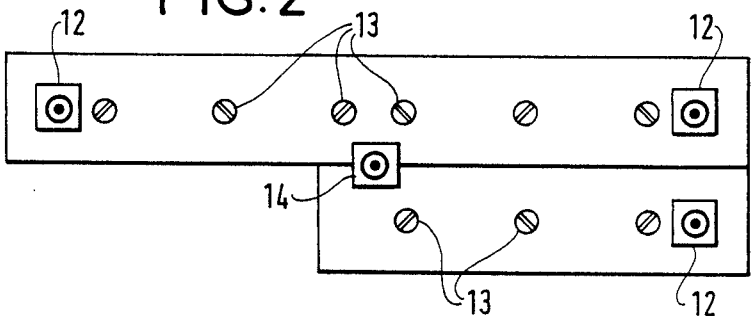
Figure 3:
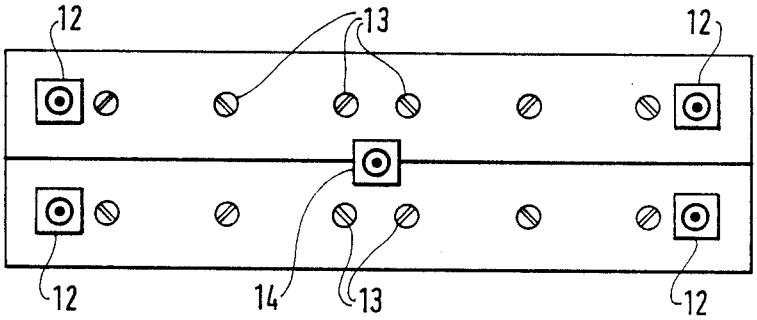
Figure 4:
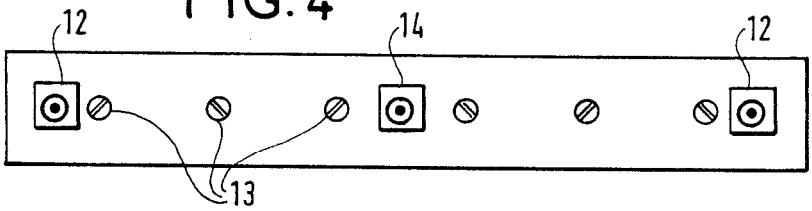

The invention relates more particularly to the common access 14 which makes it possible to provide a filter comprising two side-by-side elementary filters, as shown in FIG. 1, but which also makes it possible to provide a filter comprising three or four side-by-side elementary filters as shown respectively in FIGS. 2 and 3, or two in-line elementary filters as shown in FIG. 4.

Figure 5:
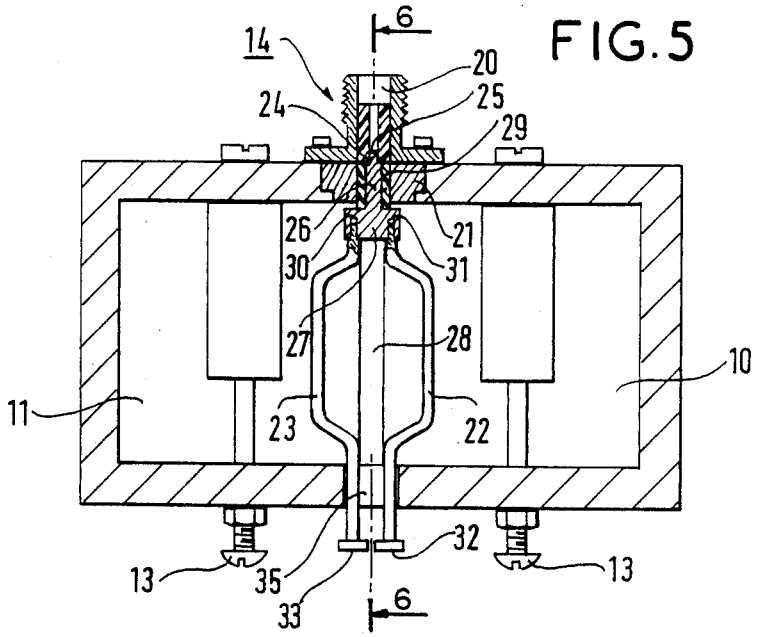
FIG. 5 is a cross-section view through a filter of the invention.
Figure 6:
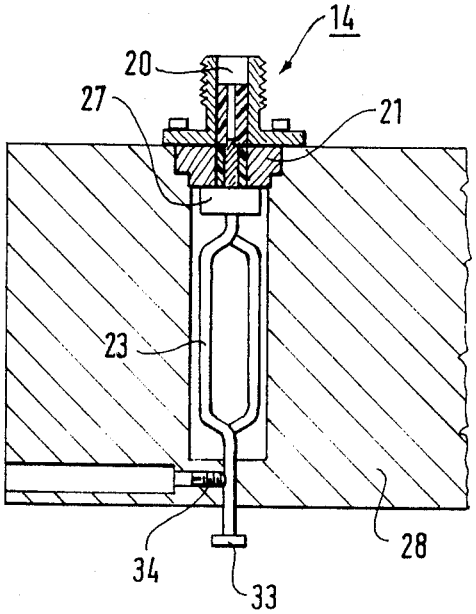
FIG. 6 is a longitudinal section on a plane VI—VI through the filter of the invention shown in FIG. 5.

The common access shown in FIGS. 5 and 6 is disposed astride the two elementary filters 10 and 11. The partition 28 at this location has been milled away partially so as to leave a passage for the antennas 22 and 23.

This common access 14 comprises:

a coaxial base 20 (e.g. of the dismountable type);

a first "plug" part 21 made of metal for closing the guide after the two crankshaft-shaped antennas 22 and 23 have been put into place, said part 21 being inserted in an opening in the wall common to the two filters in such a manner as to be clamped in place by the coaxial base;

a common part 24 for the purpose of electrically connecting the coaxial base 20 to the antennas 22 and 23. This part 24 has an end 25 of reduced size for being closely inserted inside the coaxial base. The length of the central portion 26 of this part 24 is equal to the length of an insulating tube 29 (described below) and greater than the length of the "plug" part 21 so as to ensure that there is no contact between the common part and the "plug" part. The other end 27 of this part is of greater diameter than its central portion 26, but of smaller diameter than the "plug" part 21, and has two diametrically opposite holes 30 and 31 formed therein for receiving respective small-diameter ends of the two antennas 22 and 23;

an insulating tube 29, e.g. made of polytetrafluoroethylene (PTFE), for the purpose of passing the common part 24 in order to avoid a short circuit between the common part 24 and the "plug" part 21. The diameters of the common part 24 and of the insulating tube 29 are designed so as to provide impedance matching at 50 ohms;

two coupling antennas 22 and 23 which are crankshaft-shaped, and which have smaller diameter ends for insertion as a close fit in the holes 27 and 28 of the common part 24, thereby enabling these antennas to rotate, with the opposite ends of the antennas projecting outside the filter via holes 35 disposed coaxially with the small-diameter ends. The antennas are bent in such a manner that each assembly constituting an antenna plus the common part is constrained to remain within the waveguide;

nuts 32 and 33 welded to the respective opposite ends of each antenna (22, 23), outside the waveguide in order to facilitate rotating each antenna during adjustment; and grub screws 34 passing through the filter body and bearing against respective ones of the antennas (22, 23) in order to lock them in angular position.

A filter of the invention is easily adjusted:

one of the antennas is locked in place, e.g. the antenna 22 of the first elementary filter 12, by means of the corresponding grub screw 34, thereby keeping the common part 24 in position while the second elementary filter 13 whose antenna 23 is not locked in position is adjusted, and once this filter has been adjusted, the antenna 23 of this filter 13 is locked in position by means of the corresponding grub screw; and thereafter the first antenna 22 is unlocked and the first filter 12 is adjusted, after which the antenna 22 is again locked in position.

The same principle is used for an in-line filter, as shown in FIG. 4, where the common access lies in the middle of the waveguide.

When using a "triplexer" or a "quadriplexer", as shown in FIGS. 2 and 3, the common access is disposed astride the filters and the common part is modified as shown in FIGS. 7 and 8. The largest diameter portion 39 of this part has four holes 40, 41, 42, and 43 formed therein at 90° intervals receiving respective small-diameter ends of four crankshaft-shaped antennas 44, 45, 46, and 47.

The "plug" part 48 is also modified its diameter is increased so as to be able to pass the antennas which need to be bent to a greater extent in order to be sufficiently far apart from each other. In addition, this part is held fixed to the filter by means of at least two screws 49 and 50.

The coaxial base 53 is itself fixed to the "plug" part by means of two screws 51 and 52 as shown in FIG. 7.

Such a filter is adjusted in a manner analogous to the above-described filter, namely:

the antennas in all of the filters but one are locked in place, and the filter whose antenna is not locked in place is adjusted;

once the adjustment is satisfactory, this antenna is locked in place;

the antenna of another elementary filter is then unlocked and this filter is then adjusted and its antenna is locked again;

and so on until all of the elementary filters have been adjusted in succession.

In one embodiment, the filter is made in the form of a single aluminum extrusion which is square in shape. It could have a different shape: it could be rectangular or circular (only for the in-line diplexer), and it could be made up from a plurality of parts, including a lid The two independent accesses (coaxial in this case) may be formed directly as waveguides.

In the examples shown, the "plug" part is either held in place in the waveguide by the base (FIG. 5) or else it is held in place by two screws going through the waveguide (FIG. 7), however it could also be screwed into the wall of the waveguide by providing it with a thread and by tapping the waveguide directly.

For a "triplexer" the common part 39 is identical to the common part for a "quadriplexer", however, only three crankshaft-shaped antennas are then used, leaving one hole unused. Alternatively, only three holes need be formed in the common part.

Naturally, the present invention has been described and shown merely by way of preferred example and its various component parts could be replaced by equivalent parts without thereby going beyond the scope of the invention.

We claim:

1. A multiplexed microwave filter comprising a metal filter body including a front wall and a rear wall separated by a partition wall to thereby define at least two adjoining elemental filter regions, a common access opening defined in the front wall in the vicinity of the partition wall to provide access to said adjoining elemental filter regions, a coaxial connector mounted on the outside of the filter above the common access opening, a metal plug for closing said common access opening, a central portion of said metal plug defining a common passage between the coaxial base and the adjoining elemental filter regions, a common extension formed from an electrically conductive material and extending from the coaxial connector through said common passage and into the filter body, the common extension having an end of reduced diameter extending into the coaxial connector and an enlarged antenna support portion base, an insulating tube between common extension and the metal plug and covering the reduced diameter end of the common extension where it extends through the common passage for electrically insulating the common extension from the metal plug and the filter body, and at least two crankshaft-shaped coupling antennas each having a central crank portion extending into a different said elemental filter region and each having two respective end portions oriented in opposite directions along a respective common axis of rotation, with a first of said end portions rotatably inserted in a respective first bore defined in said antenna support portion and a second of said end portions extending through a respective second bore defined in said rear wall, said respective second ends projecting outside the filter body, whereby coupling between each said antenna and its respective said elemental filter region may be adjusted by simply rotating the portion of the coupling antenna projecting outside the filter body, without interaction with the other elemental filter regions.

2. A filter according to claim 1 wherein each said coupling antenna further comprises a screw for preventing said each antenna from rotating, said screw passing through the rear filter wall and bearing against the second end portion of said each coupling antenna.

3. A method of adjusting a multiplexed microwave filter comprising a plurality of adjoining elemental filter regions, each associated with a respective one of a plurality of crankshaft-shaped coupling antennas each having a central crank portion extending into the elemental filter region and two end portions oriented in opposite directions along a common axis of rotation, with a first of said end portions rotatably inserted in a respective first bore defined in a common antenna support inside said filter body and a second of said end portions projecting outside the filter body and means for selectively locking each of the coupling antennas against rotation, the method comprising the steps:

(a) selecting a first antenna to be adjusted from said plurality of coupling antennas;

(b) locking in position all said coupling antennas except for the first antenna;

(c) adjusting the coupling between the most recently selected antenna and its associated elemental filter region;

(d) locking the most recently selected antenna in position; and thereafter (e) if and only if all said coupling antennas have not been so adjusted, selecting a previously unselected one of said antennas, unlocking said previously unselected antenna, and repeating steps (c) through (e), with said previously unselected antenna being said most recently selected antenna.

* * * * *